United States Patent [19]

Hirzel

[11] Patent Number: 4,484,510

[45] Date of Patent: Nov. 27, 1984

[54] FLUID MOTOR HAVING LOCKABLE HELICALLY DISPLACEABLE OUTPUT SHAFT

[76] Inventor: Paul M. Hirzel, 17474 Judy Ct., Utica, Mich. 48087

[21] Appl. No.: 413,916

[22] Filed: Sep. 1, 1982

[51] Int. Cl.³ ..... F15B 15/26

[52] U.S. Cl. ..... 92/24; 92/27; 92/31; 188/67; 74/527

[58] Field of Search ..... 92/15, 17, 23, 24, 27, 92/28, 31; 188/67, 31; 91/44, 41; 74/527; 192/138

[56] References Cited

U.S. PATENT DOCUMENTS

| | | | |
|---|---|---|---|
| 1,058,679 | 4/1913 | Voight . | |
| 1,285,980 | 11/1918 | Gilman | 92/15 |
| 2,412,532 | 12/1946 | Parker et al. . | |
| 2,432,096 | 12/1947 | Hammond | 188/67 |
| 2,576,554 | 11/1951 | Ashton . | |
| 2,665,712 | 1/1954 | Pratt . | |
| 2,705,939 | 4/1955 | Geyer . | |
| 2,804,054 | 8/1957 | Geyer . | |
| 2,811,136 | 10/1957 | Westcott, Jr. et al. . | |
| 2,815,005 | 12/1957 | Geyer . | |
| 3,003,471 | 10/1961 | Bodem et al. . | |
| 3,078,964 | 2/1963 | Wildhaber | 188/31 |
| 3,104,593 | 9/1963 | Clifton et al. . | |
| 3,208,357 | 9/1965 | Allen et al. . | |
| 3,260,331 | 7/1966 | Borman, Jr. . | |
| 3,264,949 | 8/1966 | Dietlin | 92/31 |
| 3,425,404 | 2/1969 | Lamkin . | |
| 3,576,151 | 4/1971 | Sendoykas . | |
| 3,736,844 | 6/1973 | Jahnke . | |
| 3,831,456 | 8/1974 | Jahnke . | |
| 3,889,576 | 6/1975 | Sheffer et al. . | |
| 3,918,346 | 11/1975 | Ziegler . | |
| 4,043,252 | 8/1977 | Wawrzyniak . | |
| 4,092,213 | 5/1978 | Nishimura | 92/17 |
| 4,116,113 | 9/1978 | Leclerc . | |
| 4,149,451 | 4/1979 | Axelsson . | |

FOREIGN PATENT DOCUMENTS

| | | |
|---|---|---|
| 650040 | 10/1962 | Canada . |
| 608704 | 10/1948 | United Kingdom . |

*Primary Examiner*—Robert E. Garrett
*Assistant Examiner*—Richard S. Meyer
*Attorney, Agent, or Firm*—Krass & Young

[57] ABSTRACT

A fluid motor comprising a piston and cylinder combination includes mechanism for locking an output shaft which is helically displaceable along its longitudinal axis upon actuation of the piston. The locking mechanism includes a locking element driven by a fluid operated motor for displacement in a direction transverse to and spaced from the longitudinal axis of the shaft, and a notch in the shaft for receiving the locking element, the notch and locking element have mating surfaces which are inclined with respect to the longitudinal axis of the shaft and transverse to the shaft's helical path of travel. The locking element motor comprises the piston and cylinder chamber defined within a body upon which there is also mounted a cam guide for guiding a cam member which is secured to the shaft on the opposite side of the notch. The locking element is secured to and extends transversely of the locking piston into an opening within the body adjacent the shaft.

10 Claims, 8 Drawing Figures

Fig-1
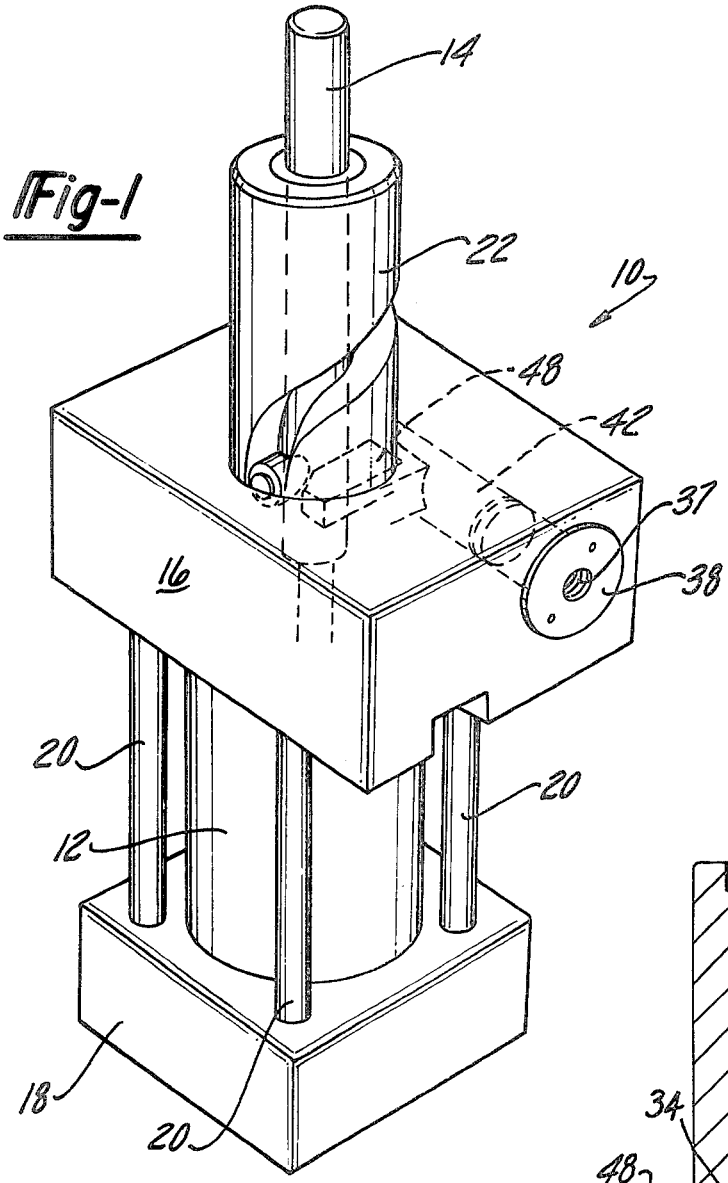
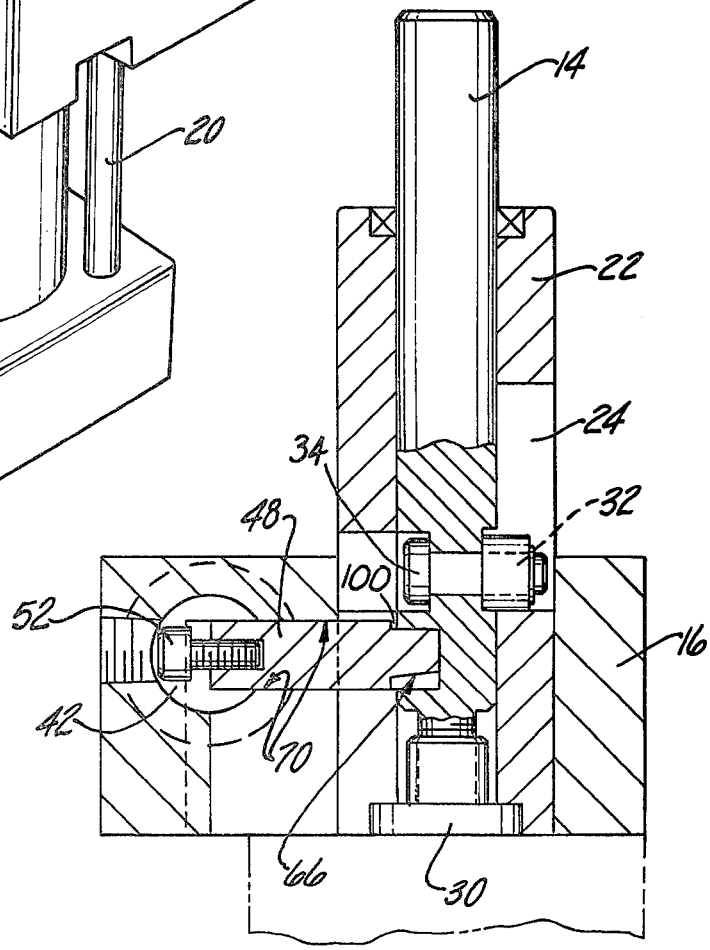
Fig-3

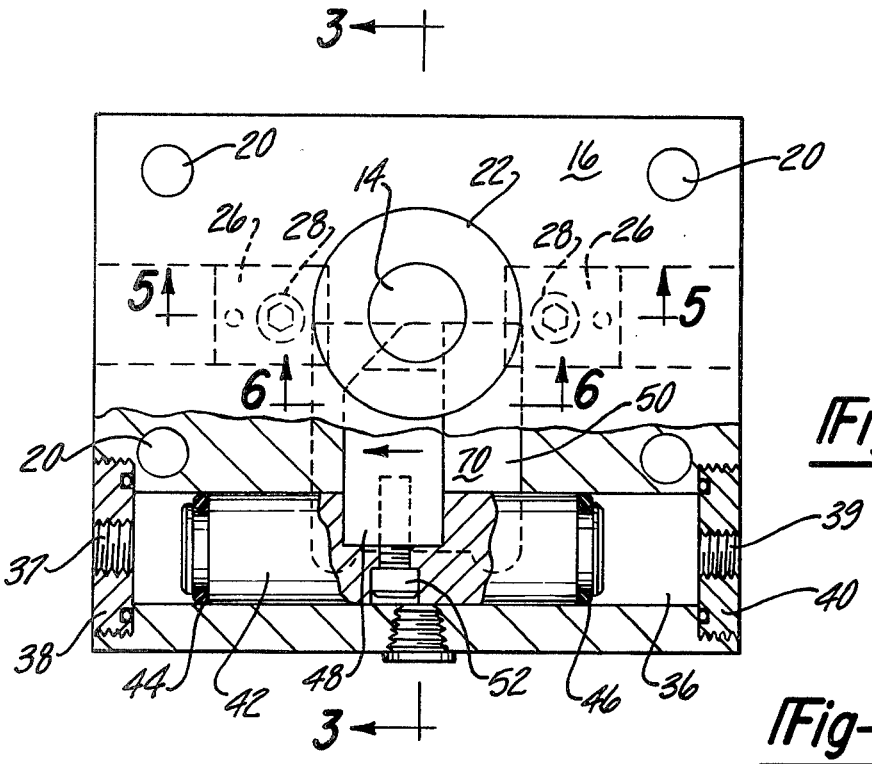
Fig-2
Fig-4
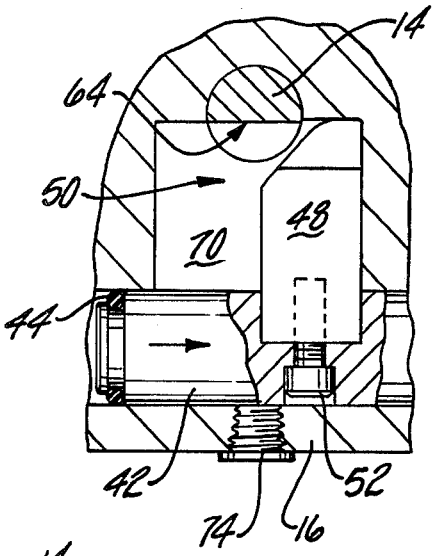
Fig-5
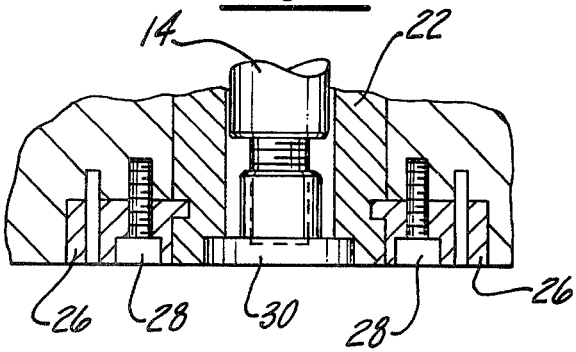
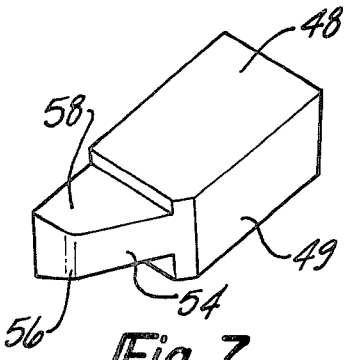
Fig-7
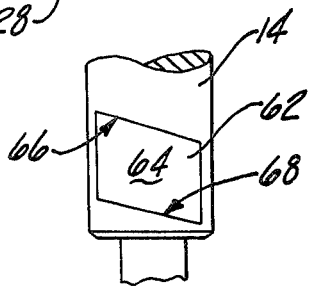
Fig-8
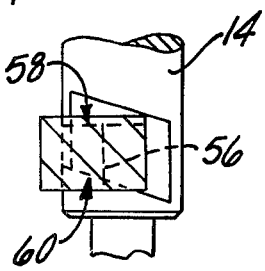
Fig-6

FLUID MOTOR HAVING LOCKABLE HELICALLY DISPLACEABLE OUTPUT SHAFT

DESCRIPTION

TECHNICAL FIELD

The present invention broadly relates to fluid operated motors of the type having a cylinder and a piston driven output shaft which rotates as it reciprocates, and deals more particularly with mechanism for locking the shaft against longitudinal movement.

BACKGROUND ART

In connection with conventional piston and cylinder type motors having a reciprocable output shaft, mechanisms for locking the shaft against longitudinal displacement are well known in the art. Such mechanisms typically include a locking element which is radially shiftable into an indentation in the shaft, or which, in some cases engages the end of the shaft when the latter is totally extended or retracted.

Fluid driven piston and cylinder combinations of the type provided with means for rotating the shaft as it is longitudinally displaced, thereby resulting in helical displacement of the shaft, are used in many applications where combined rotational and linear movement of a work piece or the like is required. In connection with these latter mentioned motors, there is sometimes also a need for providing lock-up of the shaft against displacement but the design of locking mechanisms for this purpose is considerably complicated by the fact that the shaft possess two degrees of movement, i.e., longitudinal and rotational. One factor complicating the design involves the need to provide precise registration of the reciprocating portion of the locking mechanism and that portion of the mechanism which rotates along with the shaft. In the past, a ramp surface was provided on either the shaft or the associated locking device for the purpose of accommodating manufacturing tolerances ("play") so as to impose a constant axial force on the shaft when the latter is in a locked condition. In the context of a rotatable shaft, however, such ramp surfaces are apt to impart a rotational component of force to the shaft thus tending to release the shaft from its locked position.

Another problem associated with prior art locking mechanisms for helically displaceable shafts involves the fact that the movable portion of the mechanism, usually the locking element which slides into an indentation of the shaft or associated components, requires a substantial amount of travel due to the fact that the locking element shifts in a radial direction toward or away from the longitudinal axis of the shaft.

It may therefore be appreciated that the prior art locking mechanisms described above are less than completely satisfactory in terms of their complexity and reliability. The present invention is directed toward overcoming each of the difficiencies discussed above.

DISCLOSURE OF THE INVENTION

In accordance with the present invention, a fluid motor comprising a piston and cylinder combination includes mechanism for locking an output shaft which is helically displaceable along its longitudinal axis upon actuation of the piston. The locking mechanism includes a locking element driven by a fluid operated motor for displacement in a direction transverse to and spaced from the longitudinal axis of the shaft, and a notch in the shaft for receiving the locking element, the notch and locking element having mating surfaces which are inclined with respect to the longitudinal axis of the shaft and transverse to the shaft's helical path of travel. The locking element motor comprises the piston and cylinder chamber defined within a body upon which there is also mounted a cam guide for guiding a cam member which is secured to the shaft on opposite sides of the notch. The locking element is secured to and extends transversely of the locking piston into an opening within the body adjacent the shaft.

BRIEF DESCRIPTION OF THE DRAWINGS

In the drawings, which form an integral part of the specification and are to be read in conjunction therewith, and wherein like reference numerals are employed to designate identical components in the various views:

FIG. 1 is a perspective view of a fluid motor having lockable, helically displaceable output shafts which forms the preferred embodiment of the present invention;

FIG. 2 is a top plan view of the fluid motor shown in FIG. 1, parts being broken away in section to reveal the shaft locking mechanism, the locking element being shown in a locked position;

FIG. 3 is a sectional view taken along the line 3—3 in FIG. 2;

FIG. 4 is a fragmentary, sectional view of the locking mechanism depicting the locking element in its released position;

FIG. 5 is a sectional view taken along the line 5—5 in FIG. 2;

FIG. 6 is an elevational, fragmentary view of a portion of the output shaft, depicting the locking element in its locked position;

FIG. 7 is a perspective view of the locking element; and

FIG. 8 is an elevational, fragmentary view of a portion of the shaft and depicting the notch therein.

BEST MODE FOR CARRYING OUT THE INVENTION

Referring to the drawings, the present invention is broadly concerned with a fluid motor, generally indicated by the numeral 10, having a helically displaceable output shaft 14. Motor 10 includes a cylinder 12 having a conventional fluid operated piston (not shown) slideably mounted therein and coupled with output shaft 14. Cylinder 12 is adapted to be coupled with a source of pressurized fluid so as to drive the piston therewithin in either longitudinal direction, thus causing shaft 14 to reciprocate along its longitudinal axis.

A substantially rectangular body 16 is mounted on the upper end of cylinder 12 by a plurality of longitudinally extending rods 20 which are secured to a mounting bracket 18 on the lower end of cylinder 12.

A cylindrically shaped cam guide 22 having an axial bore therethrough within which shaft 14 is slideably received is mounted on the upper end of cylinder 12. Cam guide 22 includes an annular notch on the bottom thereof for complimentally receiving a ring-shaped shoulder member 30 secured to the upper end of cylinder 12 and circumscribing shaft 14. As best seen in FIG. 5, a pair of L-shaped retaining members 26 secured within the bottom side of body 16 by means of screws 28 extend into notches within cam guide 22, thus securing cam guide 22 within body 16.

Cam guide 22 is provided with a helically extending cam slot 24 in the wall thereof and receives a cam member in a form of a roller 32 which is secured to one side of shaft 14 by means of a bolt 34 extending radially through shaft 14. With roller 32 captivated within cam slot 24 it may be readily appreciated that shaft 14 is caused to rotate upon longitudinal movement of shaft 14 by cylinder 12, in other words, shaft 14 is caused to be helically displaced about its longitudinal axis.

Mechanism for locking shaft 14 against longitudinal movement comprises a notch 62 in shaft 14, a locking element 48 and a piston member 42 slideably confined within cylinder chamber 36. Cylinder chamber 36 extends substantially perpendicular to longitudinal axis of shaft 14 and is defined by a bore through body 16. A pair of threaded fittings 38 and 40 are threadably received in body 16 at opposite ends of cylinder chamber 36 and are provided with corresponding, threaded apertures 37 and 39 which are adapted to be coupled with a suitable source of pressurized fluid. Fluid entering aperture 37 fills one side of chamber 36 and forces piston member 42 to slide toward the right, as viewed in FIG. 2. Conversely, fluid entering aperture 39 enters the other end of chamber 36 causing piston member 42 to slide toward the left as shown in FIG. 2. A pair of O-rings 44 and 46 are respectively secured to opposite ends of piston member 42 thus to prevent passage of fluid between the walls of chamber 36 and the sides of piston 42.

One end of locking element 48 is substantially rectangular in shape and is received within a corresponding rectangular depression in one side of piston 42. A screw 52 extends radially through piston 42 and into the rectangular body portion 49 of locking element 48 to secure the latter on piston 42.

Locking element 48 extends substantially perpendicular to the longitudinal axis of piston 42 and laterally outward through an elongate opening 50, in the wall of chamber 36 and opening 100 in cam guide 22. Opening 50 has a width essentially equal to that of body portion 49. And is further defined by a pair of parallel surfaces 70 which are spaced apart a distance essentially identical to the width of body portion 49 so as to closely receive the latter therebetween. Opening 50 has a length sufficient to allow locking element 48 to be slideably displaced a prescribed distance upon movement of piston 42. The opposing surfaces 70 within body 16 defining opening 50 each slideably engage opposing surfaces of body portion 49, thus preventing rotation of piston 42 within cylinder chamber 36. A threaded plug 74 is threadably received within an opening in one side of body 16 communicating with chamber 36 so as to provide an opening through which screw 52 may be inserted during mounting of locking element 48 on piston member 42.

A notch 62 is defined in one side of shaft 14 opposite the roller 32 and includes a substantially flat bottom wall 64 and a pair of opposing, spaced apart sidewall surfaces 66 and 68 each of which surfaces is inclined with respect to the longitudinal axis of shaft 14 at a prescribed angle. For illustrative purposes, surfaces 66 and 68 are depicted in the drawings as being inclined at essentially the same angle. Notch 62 is positioned at a point on shaft 14 so as to longitudinally and circumferentially register with later discussed locking surfaces of locking element 48 when shaft 14 reaches a point in its helically displacement where it is desired to lock-up shaft 14.

The outer end of locking element 48 includes a beveled corner 54 terminating in an arcuately shaped outer edge 56 extending between opposite locking faces 58 and 60. Locking face 58 is defined by a cutout area in the top of locking element 48 and extends substantially perpendicular to the longitudinal axis of shaft 14. Locking face 60, which is also defined by a cutout in the bottom of locking element 48, is substantially flat and extends from one corner of locking element 48 inwardly into the interior thereof so as to be inclined relative to the longitudinal axis of shaft 14 at an angle essentially identical to that of surface 68 of notch 62.

In operation, fluid entering aperture 37 causes piston member 42 to shift to the right as viewed in FIG. 2 thus displacing locking element 48 into clearing relationship to notch 62. As shown in FIG. 4, with locking element 48 in its released position, shaft 14 is free to be helically displaced about its longitudinal axis by cylinder 12. The fluid motor 10 may be utilized in various applications where it is necessary to both rotate and linearly displace a tool member or the like. For example, motor member 10 may be employed as a clamping device wherein a clamping member (not shown) is secured to the outer end of shaft 14. Retraction of cylinder 12 forces the clamping element downwardly against a part or the like to be clamped. After the clamping member has been drawn into its clamping position, piston 42 may be actuated to bring locking element 48 into locking relationship with notch 62. Normally, fluid pressure within cylinder 12 maintains axial clamping pressure through shaft 14. However, in the event of a loss of fluid pressure within cylinder 12, locking element 48 securely holds shaft 14 against longitudinal displacement and the locking face 60 imposes a constant, downward axial pressure on surface 68 to maintain clamping pressure.

It is important to appreciate that the locking mechanism of the present invention is particularly compact because of the fact that the locking element 48 is shiftable in a direction which is transverse to and spaced from the longitudinal axis of shaft 14, rather than radially inward towards such axis as taught by the prior art. The bevel surface 54 also contributes to compactness of the arrangement and the arcuate edge 56 assures smooth engagement with the bottom wall 64 of notch 62. The fact that locking face 60 and surface 68 of notch 62 are inclined at the same angle also provides exceptionally smooth engagement between locking element and shaft 14. Moreover, the fact that these two latter mentioned surfaces are inclined in a direction which is substantially transverse to the path of roller 32 results in a force being applied by the locking element 48 to the shaft 14 in a direction opposite to the force imposed on such shaft by the cam arrangement; consequently, maximum locking force is applied to shaft 14.

From the foregoing, it is apparent that the fluid motor having a lockable, helically displaceable output shaft described above not only provides for the reliable accomplishment of the objects of the invention but does so in a particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

I claim:

1. A fluid operated motor comprising:

a cylinder adapted to be coupled with a source of pressurized fluid;

a piston slideably mounted within said cylinder and adapted to be driven by said fluid;

a rotatable output shaft coupled with said piston and adapted to be reciprocated by said piston along the longitudinal axis of the shaft;

means for limiting the displacement of said shaft to a helical pattern upon reciprocation of said shaft by said piston in either direction along said axis; and means for locking said shaft against longitudinal movement, said locking means including (1) a notch in one side of shaft, (2) a locking element receivable in locking relationship within said notch, (3) means for mounting said locking element for sliding movement into and out of said notch and in a path spaced from and extending transverse to said axis, (4) said notch including a first surface inclined with respect to said axis, and a bottom wall extending transverse to said first surface, (5) said locking element including a locking face inclined with respect to said axis and slideably engageable with said first surface of said notch to axially bias said shaft, said locking element further including a generally curved outer face slideably engageable with said bottom wall of said notch for rotating said shaft to achieve registration between said locking face and said first surface.

2. The motor of claim 1, wherein said mounting means includes a chamber adapted to receive pressurized fluid therein and a piston member slideably disposed within said chamber, said chamber having an elongate opening therein, said locking element being secured to said piston member and extending through said opening, said locking element being laterally shiftable between the opposite extremities of said opening.

3. The motor of claim 2, wherein said locking element is elongate and has the longitudinal axis extending essentially perpendicular to the longitudinal axis of said chamber.

4. The motor of claim 2, including a body mounted on one end of said cylinder, said cylinder chamber being defined within said body, said body including pair of opposing, spaced apart surfaces adjacent said opening, at least one of said surfaces slideably supporting at least a portion of said locking element.

5. The motor of claim 1, wherein said limiting means includes a cam member secured to one side of said shaft and a helical cam member guide engaging said cam member and circumscribing said output shaft.

6. The motor of claim 5, wherein said notch is defined in a side of said output shaft opposite said cam member.

7. The motor of claim 4, wherein said locking member is disposed exterior of said cylinder and between said cam member and one end of said body.

8. A fluid operated motor, comprising:

a fluid operated motor member including a cylindrical fluid chamber and a piston slideably disposed within said chamber;

a drive shaft connected with said piston for rotation about the longitudinal axis of said shaft and displaceable along said axis of said piston between an extended position and a retracted position;

means for limiting the movement of said shaft to a helical pattern, said limiting means including a cylindrical sleeve within which said shaft is slideably received and cam means between said sleeve and said shaft for guiding the helical movement of said shaft within said sleeve; and means for locking said shaft in said retracted position thereof and for axially biasing said shaft toward said retracted position when said shaft is locked in said retracted position, said locking means including (1) a circumferentially extending opening in one side of said sleeve, (2) a notch in one side of said shaft and registering with said opening when said shaft is in said retracted position thereof, (3) an elongate locking element extending through said opening and having an outer end receivable within said notch for locking said shaft in said retracted position, said locking element being mounted for lateral sliding movement within said opening transverse to the longitudinal axis of said locking element, said locking element being slidable within said opening between a standby position in which said outer end of said locking element clears said notch and a locked position in which said outer end is received in locking engagement within said notch, and (4) motor means connected with said locking element for sliding said locking element between said locking position and said standby position.

9. The apparatus of claim 8, including a base provided with a bore therein, said sleeve being received with said bore and secured to said base, said base including an elongate slot therein substantially coextensive and registering with said opening in said sleeve, said locking element extending through said slot, said motor means being mounted on said base.

10. The apparatus of claim 8, wherein:

said notch is defined by a bottom wall and one sidewall surface, said sidewall surface being inclined relative to the longitudinal axis of said shaft at a prescribed angle, and said outer end of said locking element includes a locking surface inclined relative to said longitudinal axis generally at said prescribed angle and slideably engageable with said sidewall surface of said notch to lock said shaft and bias said shaft toward said retracted position, said outer end including a ramp surface inclined relative to said bottom wall of said notch, said ramp surface being engageable with said bottom wall to shift said shaft whereby said sidewall of said notch is in registration with said locking surface.

* * * * *